US006257455B1

(12) United States Patent
Trepina et al.

(10) Patent No.: US 6,257,455 B1
(45) Date of Patent: Jul. 10, 2001

(54) PUMP DISPENSER HAVING PASSIVE VENTING MEANS

(75) Inventors: George R. Trepina, Holland; Kenneth S. Bloom, Jerry City; Wing-Kwong Keung, Perrysburg; Doraiswami Jaichandra, Toledo, all of OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 0 days.

(21) Appl. No.: 09/466,514

(22) Filed: Dec. 17, 1999

(51) Int. Cl.[7] ..... B67D 5/58; B67D 5/40

(52) U.S. Cl. ..... 222/189.09; 222/189.11; 222/383.1

(58) Field of Search ..... 239/333; 222/383.1, 222/189.09, 189.11

(56) References Cited

U.S. PATENT DOCUMENTS

| | | |
|---|---|---|
| 3,071,276 | 1/1963 | Pellett et al. . |
| 3,448,882 | 6/1969 | Roy . |
| 4,161,288 | 7/1979 | McKinney . |
| 4,365,751 | 12/1982 | Saito . |
| 5,579,936 | 12/1996 | Costa et al. . |
| 5,730,306 | 3/1998 | Costa et al. . |
| 5,752,629 | 5/1998 | Hardy . |
| 5,882,454 | 3/1999 | Baginski . |

*Primary Examiner*—Kevin Shaver
*Assistant Examiner*—Stephanie L. Willatt

(57) ABSTRACT

A retainer for holding a pump body onto a container is formed with an annular trough having a passage offset from the axis of the retainer and permitting escape of build-up pressure in the container to the outside. The trough has a radial surface in which the passage terminates. An annular laminate layer of gas-permeable/liquid impermeable material is secured to the radial surface covering the passage.

8 Claims, 2 Drawing Sheets

PUMP DISPENSER HAVING PASSIVE VENTING MEANS

FIELD OF THE INVENTION

This invention relates to a pump dispenser adapted to be mounted on a container and having passive means for venting gas pressure from the container to the outside.

BACKGROUND OF THE INVENTION

With container mounted manual pump dispensers, it is now common to use gas-producing substances, for example, hydrogen peroxide which generates gas when it comes in contact with water containing iron. The stress produced by such positive pressure can result in deformation of the container, cracking, leakage and so on. The problem is particularly acute where, in order to reduce cost or environmental impact, thinner-walled containers are used.

U.S. Pat. No. 5,752,629 to Michael E. Hardy issued May 19, 1998 deals with the need for passive means to vent gas buildup in containers having pump dispensers attached. Specifically, the Hardy patent provides gas-permeable material preferably in a frame over an opening in the container cap provided in the pump dispenser.

While in the past mechanical means have been used to permit venting of the outside air into the container, such venting means are usually only open upon the actuation of the trigger, for instance. Such mechanical means would also vent built-up gas pressure to the outside. However, during periods of storage the trigger is never actuated and, hence, the mechanical means does not operate to permit venting of built-up gases to the outside.

It is an object of the present invention to provide in a pump dispenser passive means—as opposed to mechanical means—for venting built-up gases from the container without appreciably altering the structure of the pump and without permitting leakage of liquid product if the container tips over.

SUMMARY OF THE INVENTION

The invention is, of course, described in the claim language appended hereto. Briefly, for a pump dispenser having an inverted cup-shaped cylinder with a piston operable therein and having a downward intake tube, the invention is a retainer slidably receiving the intake tube and supporting the cylinder. The retainer has a spool-like shape with a central sleeve and a curved peripheral surface at its upper end secured to a curved surface at the lower end of the tubular support. The retainer has an annular trough concentric with its axis and features at least one passage through the retainer offset from the axis and ending in a horizontal surface of the trough to permit gas to vent from inside the container to the outside. An essential of the invention is a layer of gas-permeable, liquid-impermeable material secured to the horizontal surface over the end of the passage.

BRIEF DESCRIPTION OF THE DRAWINGS

Further objects and features of the invention will be clear to those skilled in the art from a review of the following specification and drawings, all of which present a non-limiting form of the invention. In the drawings.

DESCRIPTION OF THE PREFERRED EMBODIMENTS

Figure 1:
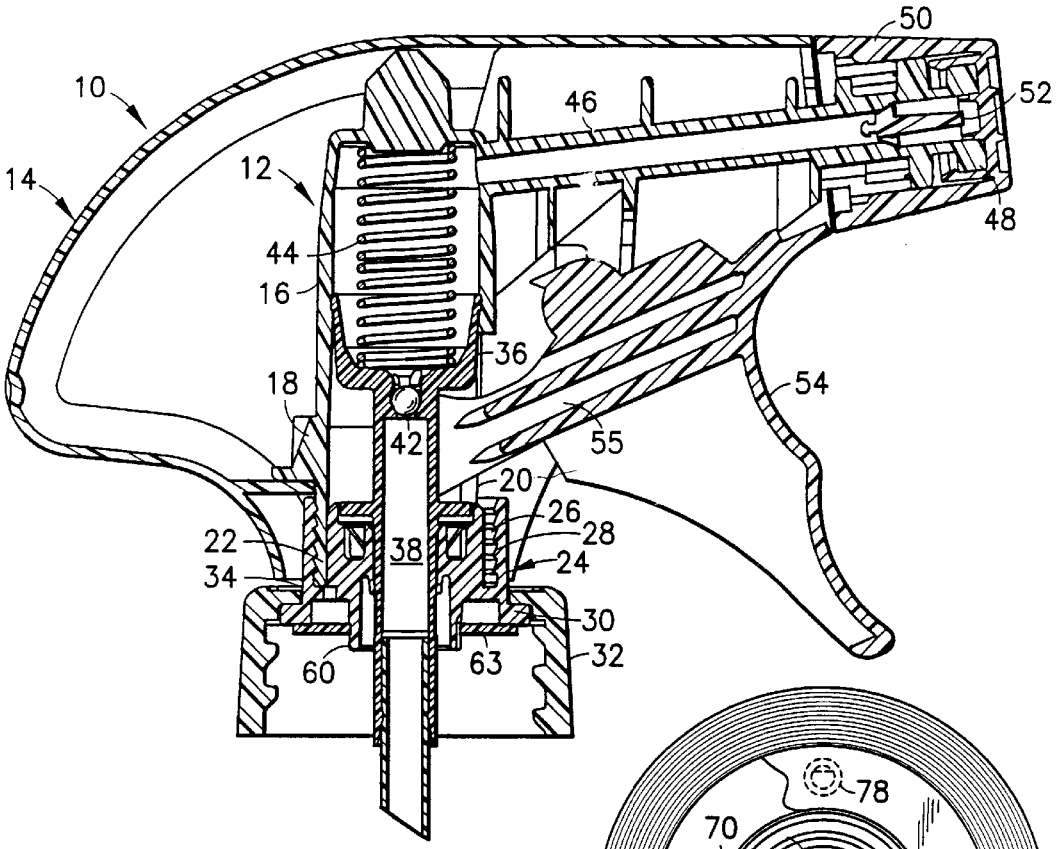
FIG. 1 is a sectional view of a pump dispenser embodying the invention.

A pump dispenser embodying the invention is shown in FIG. 1 and generally designated 10. It comprises a pump body 12,and a shroud 14. The pump body includes the inverted cup-shaped cylinder 16 which is integral with a tubular support 18. The tubular support has a cut away portion 20. The lower end is cylindrical and formed on its outer surface with a series of ridges 22. A spool-like retainer 24 is formed with an annular well 26 having inward ridges 28 to inter-engage with the ridges on the lower end 22 of the tubular support to firmly hold the tubular support.

The retainer is formed on its lower end (FIG. 2) with an outward annular flange 30 having a grooved undersurface 30A. A screw cap closure 32 has an opening 34 in its top wall which receives the lower end of the retainer, above the flange 30. The closure and retainer are, thus, rotatably related so that the dispenser can be installed on a container by screwing on the closure 32 while the pump may be held from movement.

A piston 36 operates in the cylinder 16. It has a stem in the form of a downward intake tube 38 which is slidably received into axial opening 40 in the spool-like retainer 24. At its upper end the intake tube 38 is provided with a check valve compartment holding a check valve ball 42 which seats in the chamber in a well known manner. A spring 44 biases the piston 36 downward.

From an upper portion of the cylinder a delivery tube 46 extends forwardly and terminates in a nozzle fitting 48 which receives a nozzle cap 50. A movable check valve 52 is provided in the forward end of the delivery tube 46 as described in U.S. Pat. No. 5,687,877 assigned to our assignee. A trigger lever 54 is pivoted to the pump body and has rearward arms 55 by which, upon pulling the trigger, the piston can be raised to accomplish the pumping action. The shroud 14 may be attached to the pump body 12 in a manner described in the U.S. Pat. No. 5,890,632 also assigned to our assignee.

It is well known in the art as exemplified in the U.S. Pat. No. 4,161,288 to McKinney to provide on the intake tube 38 longitudinal grooves to, when the trigger is pulled and the piston raised, permit air to pass into the container by way of such grooves. This is thoroughly disclosed in the McKinney patent with special reference to FIG. 2 thereof, and comparable structure is employed in the present pump dispenser for such mechanical venting, though not shown in detail here.

Figure 2:
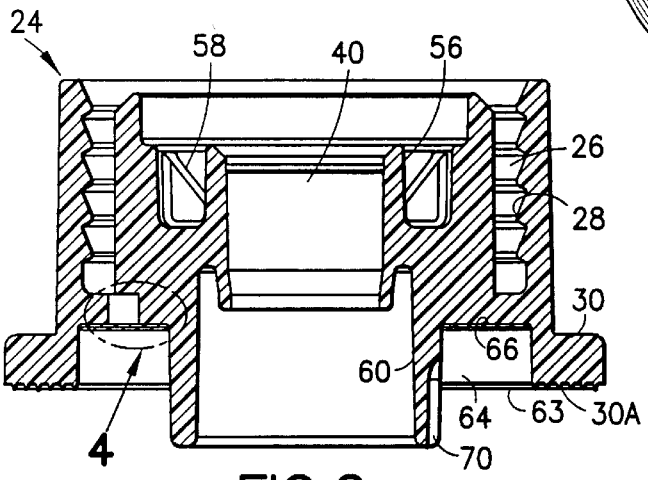
FIG. 2 is an enlarged sectional view of the retainer assembly including the gas-permeable material.

Attention is now directed to FIG. 2 herein which is an enlargement of the retainer 24. Inward from the annular well 26 the retainer is formed with an axial sleeve 56 which defines the intake-tube-receiving opening 40 referred to above. Surrounding the upper portion of the sleeve 56 are a plurality of outward radial ribs 58 to reinforce the sleeve 56. Outward from the sleeve the retainer is formed with a barrel 60 which extends below the grooved annular surface 30A of the flange 30. In assembly, a flat annular gasket 63 is fitted against the grooved surface 30A of the flange 30 and snugly embraces the lower end of the barrel 60.

Figure 3:
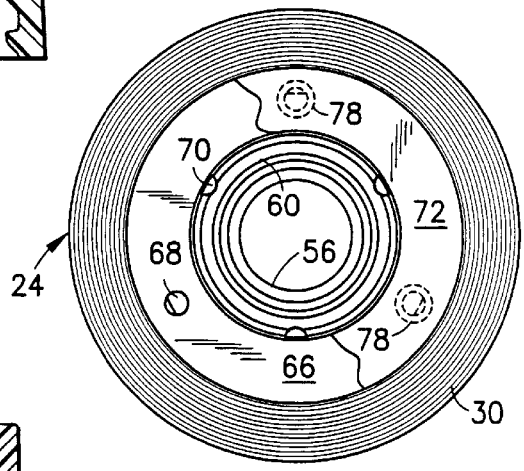
FIG. 3 is a bottom plan view of the retainer assembly with the material partly broken away.
Figure 4:
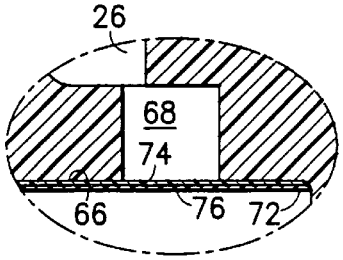
FIG. 4 is a greatly enlarged fragmentary view of a portion of FIG. 2.
Figure 5:
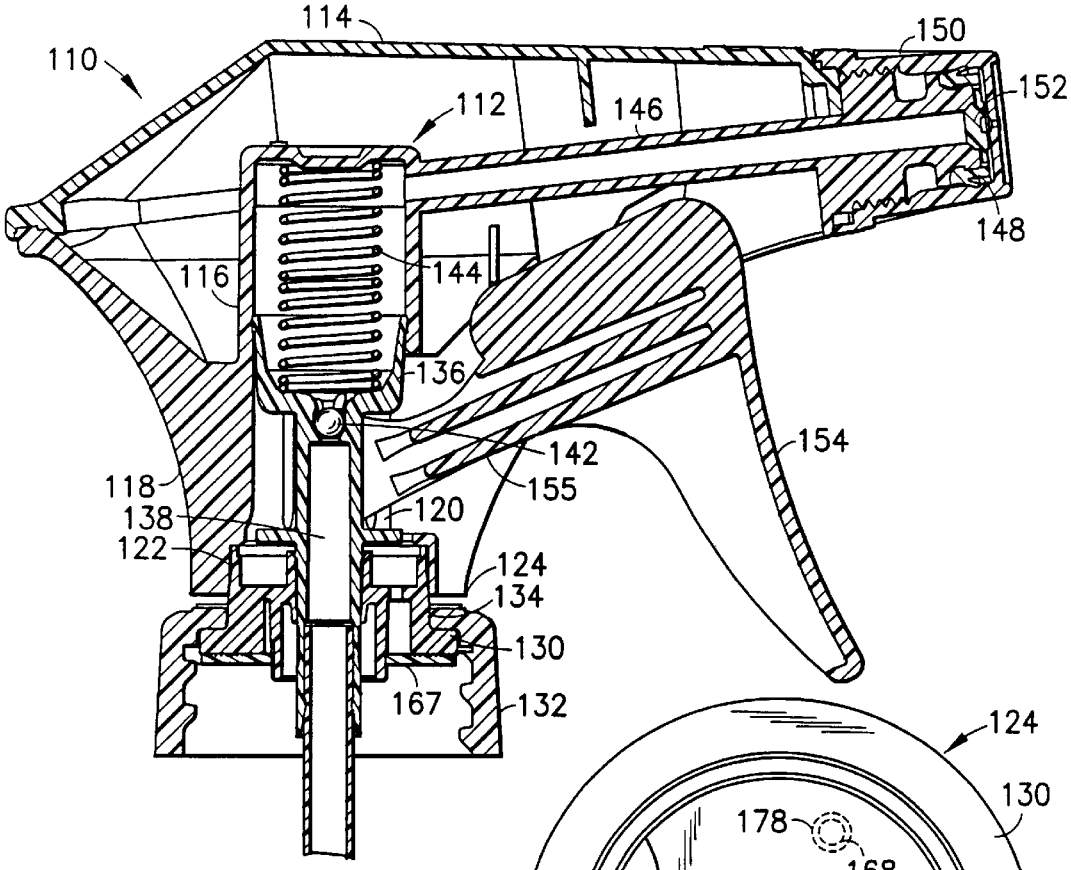
FIG. 5 is a sectional view of an alternate pump dispenser having a modified form of retainer assembly.
Figure 7:
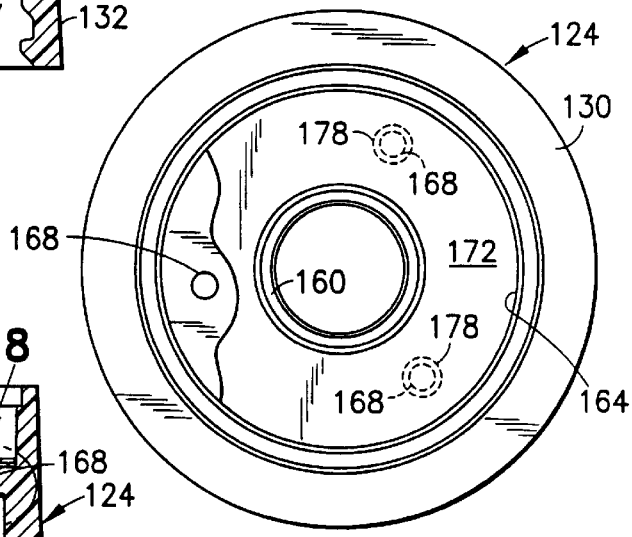
FIG. 7 is a top plan view of the retainer assembly of FIG. 6 with the material partly broken away.

Attention is now directed to an area in which an essential of the invention lies. Extending upward surrounding the barrel 60 is an inverted annular trough 64 (FIG. 2) concentric with the axis of the retainer. The upper surface 66 of the trough is flat and radial with respect to the axis. At a plurality of positions, upward passages 68 (FIGS. 3, 4) are formed in the retainer, extending from the surface 66 upward into the annular well 26. This constitutes a passage for gases which may build up in the head space of the container due to gases being generated or coming out of solution in the liquid product in the container.

To permit such gas to pass into the annular trough 64 around the gasket 63, the barrel 60 is formed with at least one longitudinal notch 70 (FIG. 2) on its exterior. The radial surface 66 of the trough 64 is covered with a laminate 72 (FIG. 4) formed of complementary annular shape.

The material of laminate 72 is selected of known compositions as being permeable to gas but not permeable to liquid. Illustratively, the laminate may be a layer 74 of porous expanded PTFE with a backing of woven polypropylene fabric 76 The polypropylene layer is placed contiguous to the surface 66. Polypropylene is chosen to be in harmony with the polypropylene of the retainer itself. In assembly, the polypropylene is welded to the surface 66 of the inverted trough. The welding technique, preferably ultrasonic, is as generally described in the prior art with a preferred technique employed by Performance Systematix, Inc. of Caledonia, Mich. 49316. The process leaves lines of indentations 78 in the laminate 72. These may circumscribe each hole 68, or may follow both the inner and outer periphery of the annulus (not shown).

In being disposed against the surface 66 all the way around the annular trough 64, the laminate, of course, covers the upward passages 68 and controls the passage therethrough of any media. During periods of storage of the container and pump, gas may communicate freely through the notch 70, through annular trough 64, through the laminate 72 into upward passage 68 and finally into the annular well 26 which is open to the atmosphere by virtue of the cut-out 20 and various passages between the retainer and the tubular support 18 through which gas may sneak. Being thus relieved of pressure, the container on which the dispenser is mounted is not subject to misshaping, splitting or other damage caused by internal pressure.

Second Embodiment

The second embodiment shown in FIGS. 5 through 8, with the exception of differences in the retainer, is generally similar to the structure of the first embodiment in FIGS. 1 through 4. The pump dispenser of this second embodiment is generally designated 110 in FIG. 5. It comprises a pump body 112 and a cover 114. The pump body includes an inverted cup-shaped cylinder 116 which is supported on a lower half 118 of the dispenser body. The lower half 118 is formed with an opening 120 in the front thereof and is formed with a downward circular recess 122 into which is secured the upper portion of a retainer 124. The retainer is formed at its lower end with an outward flange 130 with grooved undersurface 130A and is received into the opening 134 in the top wall of a screw-type closure 132.

Operating in the cylinder 116 is the piston 136 which has a downward intake tube 138. At the upper end the intake is formed with a chamber which loosely receives and seats a check valve ball 142 in the usual manner. Spring 144 urges the piston downward. Adjacent the upper end of the cylinder 116 a delivery tube 146 extends forward and terminates in a fitting 148 receiving a nozzle cap 150. The forward end of the delivery tube is provided with a check valve 152 as described in the McKinney patent. A trigger lever 154 is pivoted to the pump body and has a rearward arm 155 which operates the piston.

Figure 6:
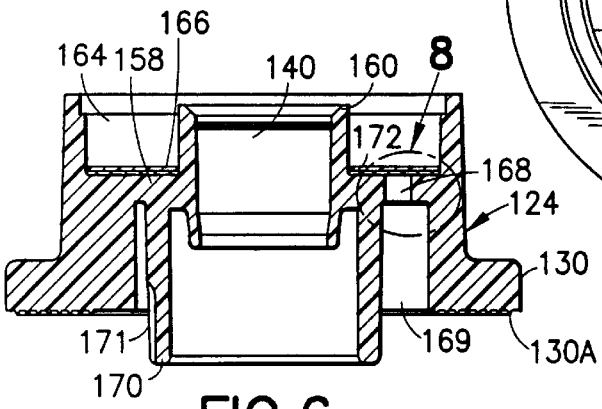
FIG. 6 is an enlarged sectional view of the retainer assembly of the pump dispenser of FIG. 5.
Figure 8:
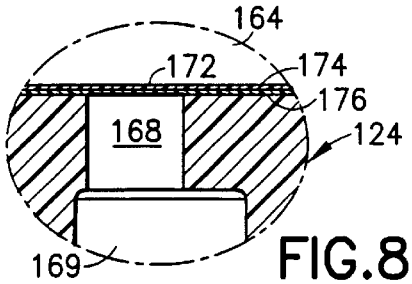
FIG. 8 is a greatly enlarged fragmentary view of a portion of FIG. 6.

Focusing now on the spool-like retainer structure 124, an enlargement of which is shown in FIG. 6, the retainer is formed with an inward floor 158 which supports an axial sleeve 160 which defines the opening 140. Outward from the sleeve 160 the retainer is formed with an annular downward trough 164 concentric with the axis of the retainer. The trough terminates downward in a radial surface 166 which is formed with downward passages (FIG. 7) 168. Each passage 168 communicates with an upward annular well 169. Inward from the well 169 a barrel 170 extends downward and is notched at 171. A gasket 167 is provided as with the first embodiment.

The radial surface 166 of the trough 164 is covered with a laminate 172 formed in complementary annular shape. Illustratively, the laminate may be a layer 174 of porous expanded PTFE with a backing of woven polypropylene fabric 176 The polypropylene layer is placed contiguous to the surface 166. Polypropylene is chosen to be in harmony with the polypropylene of the retainer itself. In assembly, the polypropylene is welded to the surface 66 of the inverted trough. The welding technique, preferably ultrasonic, is as generally described in the prior art with a preferred technique employed by Performance Systematix, Inc. of Caledonia, Mich. 49316. The process leaves lines of indentations 178 in the laminate 172. These may circumscribe each hole 168, or may follow both the inner and outer periphery of the annulus (not shown).

In being disposed against the surface 166 all the way around the annular trough 164, the laminate, of course, covers the upward passages 168 and controls passage of media therethrough.

During periods of storage, the gas may pass through the notch 171, through inverted annular well 169, through the passages 168, the laminate 172 and finally into the annular trough 164 which is open to the atmosphere by virtue of the cut-out 120. Being thus relieved of pressure, the container on which the dispenser is mounted is not subject to misshape, splitting or other damage caused by internal pressure.

Variations in the invention are possible. Thus, while the invention has been shown in only two embodiments, it is not so limited but is of a scope defined by the following claim language which may be broadened by an extension of the right to exclude others from making, using or selling the invention as is appropriate under the doctrine of equivalents.

What is claimed is:

1. A pump dispenser comprising:

1) an inverted cup-shaped cylinder, a piston operatively disposed in the cylinder, the piston having a downward inlet tube;

2) a support portion for the cylinder having a lower end;

3) a spool-like retainer having an axis, an upper end secured to the lower end of the support portion, the retainer having a central sleeve receiving the inlet tube in sliding relation, the retainer having an annular trough concentric with the axis of the retainer, the trough having an annular radial wall and formed with a plurality of passages through the retainer positioned at spaced points about the axis and terminating in ends in the radial wall, 4) a container closure disposed about the lower end of the retainer, and 5) a flat annular laminate of gas-permeable, liquid-impermeable material disposed concentrically in the annular trough and to the radial wall over the ends of the passages.

2. A pump dispenser as claimed in claim 1 wherein the trough extends upward in a lower portion of the retainer.

3. A pump dispenser as claimed in claim 1 wherein the trough extends downward in an upper portion of the retainer.

4. For a pump dispenser having a vertical inverted cup-shaped cylinder having an axis, a piston operative in the cylinder, the piston having a downward tubular inlet stem, the cylinder having an integral downward support terminating in a curved surface concentric with the axis, a spool-like retainer having a central sleeve adapted to slidably receive the tubular inlet and an integral barrel extending downward and of a larger diameter than the sleeve, the barrel having an outer surface formed with a longitudinal notch, the retainer having a curved surface at its upper end adapted to be secured to the curved surface of the support, the retainer having an outward annular flange at its lower end by which the retainer is adapted to be clamped to a container finish, the retainer also having an annular trough concentric with the axis and having a horizontal surface and a passage through the retainer and offset from the axis ending in the horizontal surface of the trough, an annular gasket snugly surrounding the barrel, the notch being adapted to permit passage of pressure in the container, and a layer of gas-permeable, liquid-impermeable fabric secured to the horizontal surface over the end of the passage.

5. A method of providing a passive vent for a pump dispenser/container assembly comprising the steps of:

1) providing a spool-like retainer having a central sleeve adapted to slidably receive a tubular piston inlet stem and a curved surface at its upper end concentric with the axis of the sleeve and adapted to be secured to a complementarily curved surface on the dispenser, the retainer having an annular trough concentric with the axis, the trough having a horizontal surface and a plurality of passages through the retainer positioned at spaced points about the axis, the passages each being offset from and generally parallel to the axis and having an end in the horizontal surface, 2) providing an annular flat laminate of gas-permeable, liquid-impermeable material, and 3) welding the laminate onto the horizontal surface of the trough over the ends of the pluralities of passages.

6. In a pump dispenser comprising:

1) an inverted cup-shaped cylinder, a piston operatively disposed in the cylinder, the piston having a downward inlet tube;

2) a support for the cylinder having a generally circular upward recess in its lower end;

3) a spool-like retainer having an axis, a circular upper end receiving the upward circular recess, the retainer having a central sleeve receiving the inlet tube in sliding relation, the retainer having an annular trough concentric with the axis of the retainer, the trough having a radial wall formed with a plurality of passages through the retainer terminating in openings in the radial wall, the passages being positioned at spaced points about the axis, 4) a container closure secured to the lower end of the retainer, the improvement of a flat annular layer of gas-permeable, liquid-impermeable laminate welded to the radial wall over the ends of all of the passages.

7. A pump dispenser as claimed in claim 6 wherein the laminate comprises layers of PTFE and polypropylene.

8. A pump dispenser as claimed in claim 7 wherein the polypropylene layer is contiguous to the radial wall.

* * * * *